US011848165B2

(12) United States Patent
Yang et al.

(10) Patent No.: US 11,848,165 B2
(45) Date of Patent: Dec. 19, 2023

(54) CERAMIC REED SWITCH

(71) Applicant: Jiaxing Hongyu Technology Co., Ltd, Zhejiang (CN)

(72) Inventors: Dongfeng Yang, Zhejiang (CN); Tao Gou, Zhejiang (CN)

(73) Assignee: Jiaxing Hongyu Technology Co., Ltd, Zhejiang (CN)

( * ) Notice: Subject to any disclaimer, the term of this patent is extended or adjusted under 35 U.S.C. 154(b) by 0 days.

(21) Appl. No.: 17/841,684

(22) Filed: Jun. 16, 2022

(65) Prior Publication Data

US 2023/0037118 A1 Feb. 2, 2023

(30) Foreign Application Priority Data

Jul. 27, 2021 (CN) ..... 202110849376.X

(51) Int. Cl.
*H01H 1/66* (2006.01)
*H01H 1/02* (2006.01)
*H01H 1/58* (2006.01)

(52) U.S. Cl.
CPC ..... *H01H 1/66* (2013.01); *H01H 1/0201* (2013.01); *H01H 1/58* (2013.01)

(58) Field of Classification Search
CPC ..... H01H 1/66; H01H 1/0201; H01H 1/58
See application file for complete search history.

(56) References Cited

U.S. PATENT DOCUMENTS 3,098,908 A * 7/1963 Heath ..... H01H 51/287 200/266
3,124,670 A * 3/1964 Rose, Jr. ..... H01H 51/281 335/196
3,559,124 A * 1/1971 Posey ..... H01H 36/0013 335/206

* cited by examiner

*Primary Examiner* — Bernard Rojas
(74) *Attorney, Agent, or Firm* — JCIPRNET

(57) ABSTRACT

A ceramic reed switch includes a ceramic tube, and a first end cover and a second end cover, a first pin is disposed on an outer side of the first end cover, a first magnetic reed is disposed on an inner side of the first end cover, the first magnetic reed forms a cantilever beam structure on the first end cover, a second pin is disposed on an outer side of the second end cover, a second magnetic reed is disposed on an inner side of the second end cover, the second magnetic reed forms a cantilever beam structure on the second end cover, free ends of the first magnetic reed and the second magnetic reed are overlapped in the ceramic tube and form an air gap, and a contact is disposed on an overlapped end of the first magnetic reed and the second magnetic reed.

7 Claims, 1 Drawing Sheet

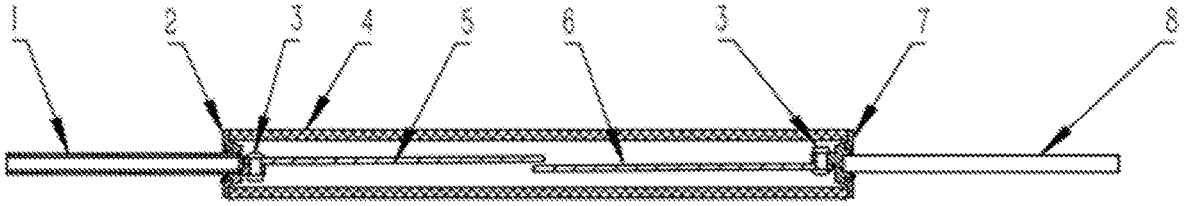
1
2
3
4
5
6
3
7
8

CERAMIC REED SWITCH

CROSS-REFERENCE TO RELATED APPLICATION

This application claims the priority benefit of China application no. 202110849376.X, filed on Jul. 27, 2021. The entirety of the above-mentioned patent application is hereby incorporated by reference herein and made a part of this specification.

FIELD OF TECHNOLOGY

The present invention belongs to the field of reed switch technologies, and in particular, to a ceramic reed switch.

BACKGROUND

A magnetic reed switch is also referred to as a reed switch and is an electric switch operated by using an applied magnetic field. A basic form is that two magnetic reeds are sealed in a glass tube, and although the two magnetic reeds overlap, a small air gap exists between the two magnetic reeds. The two magnetic reeds are attracted and in contact with each other through an externally applied magnetic field, and contact connection is implemented when currents pass through the magnetic reeds. Once the magnetic field is far away from the switch or disappears, the magnetic reeds return to an initial state under the action of elastic reaction forces of the magnetic reeds, and the air gap is formed at an overlapped part between the two magnetic reeds again, and contact disconnection is implemented, to cut off a circuit.

Therefore, a conventional reed switch is a structure in which a magnetic circuit and a circuit are combined. A working principle of the magnetic reed switch is very simple. An overlapped soft magnetic at end points of the two magnetic reeds sealed with an alloy reed (usually made of iron and nickel) is sealed in a glass tube. The two reeds are overlapped and separated by a small air gap (only about tens to hundreds of microns), and the contacts on the two reeds are plated with a layer of hard noble metal, which is usually rhodium and ruthenium, and the layer of hard noble metal greatly improves the switching service life and the contact reliability. The glass tube is filled with high-purity inert gas, and a high vacuum state is formed in some reed switches to improve the high-pressure performance of the glass tube.

The reed switch has the characteristics of a simple and reliable structure, good in contact airtight environment adaptability and safety, and a long service life as a magnetic control proximity switch (a magnetic control sensor) and a reed relay core part, and is widely applied to various fields such as household appliances, transportation equipment, monitoring equipment, aerospace, national defense and the like. In addition, a large-load reed switch and a reed relay are ideal switch elements for electric control systems of short-wave communication, electrical trains, and explosion-proof electric appliances. When a conventional reed switch is connected to a large-load current or a high-frequency current, due to relatively high resistivity of a soft magnetic reed, the current easily makes the reed heat, resulting in high-temperature demagnetization of the magnetic circuit and unreliable contact between the attracted contacts. Because a pin of the conventional glass reed switch is also an alloy of iron and nickel with an expansion coefficient close to glass and soft magnetism and has the characteristics of large resistivity and large pin bending stress. In addition, the pin and the soft magnetic reed together form a magnetic circuit of the reed switch. During use, pin cutting or bending directly cause a change of the magnetic circuit of the reed switch, to cause a change of a key technology index AT value (contact action ampere turn value) of the reed switch, resulting in a change of a driving parameter of the reed switch with different installation manners. As a result, the AT value precisely controlled in the design and manufacturing process can only be a reference value in actual use, and the consistency of the circuit cannot be ensured. In addition, due to a large bending stress of the alloy of iron and nickel, especially, breaking of the glass tube or air leakage at the sealed part of the reed switch often occurs when the large-load reed switch with a large diameter is actually used, which seriously damages the use reliability of the reed switch. These defects are the inherent defects of the current glass reed switch products and are difficult to overcome.

SUMMARY

Aiming at the problems in the prior art, the present invention aims to provide the technical solution of a ceramic reed switch.

The present invention is specifically implemented through the following technical solutions.

The ceramic reed switch includes a ceramic tube, and a first end cover and a second end cover disposed on two ends of the ceramic tube, where a sealed chamber is inside the ceramic tube, a first pin is disposed on an outer side of the first end cover, a first magnetic reed is disposed on an inner side of the first end cover, the first magnetic reed forms a cantilever beam structure on the first end cover, a second pin is disposed on an outer side of the second end cover, a second magnetic reed is disposed on an inner side of the second end cover, the second magnetic reed forms a cantilever beam structure on the second end cover, free ends of the first magnetic reed and the second magnetic reed are overlapped in the ceramic tube and form an air gap, and a contact is disposed on an overlapped end of the first magnetic reed and the second magnetic reed.

Under the action of an external magnetic field in a left-right direction, magnetic flux flows through the first magnetic reed and the second magnetic reed so that the first magnetic reed and the second magnetic reed attract each other at the air gap and are finally closed to cause a circuit to be connected, and after the external magnetic field disappears, the first magnetic reed and the second magnetic reed cause the contact to be separated and restored to an initial state under the action of elastic restoring forces of the first magnetic reed and the second magnetic reed, so that the circuit is cut off.

Further, the first pin is a hollow tube, the first pin is hermetically welded to the first end cover, and an air hole passing through left and right is provided at a position where the first end cover corresponds to a center hole of the first pin.

Further, a boss is disposed on an inner side end of the first end cover, and the boss is connected to the first magnetic reed through a rivet or through welding.

Further, the first magnetic reed and the second magnetic reed form the contact on the overlapped end by coating a noble metal.

Further, the second pin is a solid pin, and the second pin and the second end cover are hermetically welded.

Further, a boss is disposed on an inner side end of the second end cover, and the boss is connected to the second magnetic reed through a rivet or through welding.

Further, the first pin and the second pin are pins made of non-magnetic oxygen-free copper materials.

Further, metallization layers are disposed on two end surfaces of the ceramic tube.

The present invention has the following advantageous effects:

1. A tube body adopts a ceramic tube, a mechanical thickness of the ceramic tube is uniform, a brazing process and a mechanical strength of the ceramic tube are far higher than that of a glass tube, and an inherent defect that a conventional reed switch is prone to being broken is eliminated. In addition, a residual boss after an exhaust pipe on a cylindrical surface of a conventional vacuum reed switch is sealed is eliminated, an appearance size is also reduced, and the hidden danger of air leakage is basically eliminated.

2. Unlike a conventional glass reed switch, it needs to take soft magnetic performance, an elastic restoring force, and matching performance with the glass tube into account, a magnetic reed is not related to sealing and can select a reed material with a higher Curie temperature and better soft magnetic performance and electrical conductivity. In addition, the defects that the magnetic conductivity is reduced caused by heating of a magnetic reed of a conventional large-load reed switch and the contact reliability of a contact of the reed switch is reduced when the reed switch has a large-load current or high-frequency current are overcome.

3. A pin made of non-magnetic and oxygen-free copper material is used, so that when a pin of the conventional reed switch affects a magnetic circuit, factors for which pin cutting or bending causes a change of a reed switch AT value when the reed switch is use are eliminated.

4. The structure is suitable for an existing mature technology of ceramic electric vacuum, and is suitable for standardization and wholesale and retail manufacturing, so that the quality consistency of a product is ensured.

5. The structure inherits the advantage of a simple and reliable structure of a conventional reed switch, and avoids the inherent defects of a conventional reed switch technology.

BRIEF DESCRIPTION OF THE DRAWINGS

FIGURE is a schematic structural diagram of the present invention.

In the drawings: 1. First pin; 2. First end cover; 3. Rivet; 4. Ceramic tube; 5. First magnetic reed; 6. Second magnetic reed; 7. Second end cover; 8. Second pin.

DESCRIPTION OF THE EMBODIMENTS

Clear and intact description will be made on technical scheme in the embodiment of the present invention below in combination with drawings in the embodiment of the present invention. The described embodiments are merely a part of embodiments of the present invention and are not all the embodiments. Based on the embodiments of the present invention, all the other embodiments obtained by those of ordinary skill in the art without inventive effort are within the scope of the present invention.

Referring to FIGURE, a ceramic reed switch includes a ceramic tube 4. Metallization layers may be disposed on two end surfaces of the ceramic tube 4. A first end cover 2 and a second end cover 7 are disposed on two ends of the ceramic tube 4, and the first end cover 2 and the second end cover 7 may be fixed to the ceramic tube 4 by welding. The first end cover 2 and the second end cover 7 are made of a soft magnetic metal material. The first end cover 2, the second end cover 7, and the ceramic tube 4 may form a sealed chamber. A first pin 1 is disposed on an outer side of the first end cover 2, a first magnetic reed 5 is disposed on an inner side of the first end cover, and the first magnetic reed 5 forms a cantilever beam structure on the first end cover 2. Specifically, the first pin 1 may be a hollow tube, the first pin 1 is hermetically welded to the first end cover 2, and an air hole passing through left and right is provided at a position where the first end cover 2 corresponds to a center hole of the first pin 1, to implement air extraction and exhaust. A boss is disposed on an inner side end of the second end cover 2, and the boss is connected to the first magnetic reed 5 through a rivet 3 or through welding. The first magnetic reed 5 forms the cantilever beam structure by disposing a boss structure. A second pin 8 is disposed on an outer side of the second end cover 7, a second magnetic reed 6 is disposed on an inner side of the second end cover, and the second magnetic reed 6 forms a cantilever beam structure on the second end cover 7. Specifically, the second pin 8 is a solid pin, and the second pin 8 and the second end cover 7 are hermetically welded. Similarly, a boss is disposed on an inner side end of the second end cover 7, and the boss is connected to the second magnetic reed 6 through a rivet 3 or through welding. The first pin 1 and the second pin 8 are pins made of non-magnetic oxygen-free copper materials.

Free ends of the first magnetic reed 5 and the second magnetic reed 6 overlap in the ceramic tube 4 and form an air gap. A contact is disposed at an overlapped end of the first magnetic reed 5 and the second magnetic reed 6, and the contact is formed by a noble metal material coated on the first magnetic reed 5 and the second magnetic reed 6 or formed by directly disposing a contact made of a noble metal material on the first magnetic reed 5 and the second magnetic reed 6, where the noble metal material is, for example, a rhodium metal.

When a magnetic field is externally applied in an axial direction of the ceramic tube 4, the magnetic field flows through a magnetic circuit formed by the first end cover 2, the first magnetic reed 5, the second magnetic reed 6, and the second end cover 7 and generates magnetic field attraction at the air gap, so that the free ends of the first magnetic reed 5 and the second magnetic reed 6 acts until the air gap disappears and the contact is completely closed. After the externally applied magnetic field disappears, the air gap is restored under the action of elastic restoring reaction forces of the first magnetic reed 5 and the second magnetic reed 6, and the contact is disconnected, to complete a switch loop.

In this embodiment, two ends of the ceramic tube 4 are metalized, and the first end cover 2 and the second end cover 7 adopt a typical vacuum ceramic brazing sealing process, the technology is mature, the mechanical strength is high, and the sealing is reliable. In addition, with oxygen-free copper, the first pin 1 and the second pin 8 are relatively soft, and the bending stress is small, so that the hidden danger of glass tube breaking or air leakage caused by a force of a circuit lead and high temperature during welding due to a large bending stress of a pin of an alloy of iron and nickel during use of a conventional large-load or vacuum high-pressure reed switch is completely eliminated.

In this embodiment, the first magnetic reed 5 and the second magnetic reed 6 are not welded to the ceramic. Because the magnetic reed of the conventional reed switch has to adopt the alloy of iron and nickel sealed with a glass, the matching sealing alloy has relatively large resistivity and relatively low heat conductivity and magnetic conductivity. During actual use, when a large-load current and a high-frequency current pass through the magnetic reed of the reed switch, a temperature of the reed increases due to heating of a resistor. As a result, magnetic performance of the reed is reduced and magnetic attraction is reduced and even disappears, resulting in an abnormal disconnection of the contact or unreliable contact. In the present invention, the magnetic reed may select any soft magnetic alloy with better magnetic conductivity, electric conductivity, and heat conductivity and a higher Curie temperature without considering the matching performance with the ceramic. Therefore, a load capability of the reed switch and the on-off reliability of the contact can be effectively improved.

In this embodiment, the first pin 1 and the second pin 8 generally adopt a non-magnetic oxygen-free copper material, and the pin is not a part of the magnetic circuit. However, a pin of the conventional reed switch is made of an alloy of iron and nickel matching glass and has soft magnetism, and the pin is inevitably a part of the magnetic circuit. During actual use, pin cutting and bending cause a change of a key technology parameter AT value (an action ampere turn value of the reed switch) of the reed switch. By adopting a structure of the first pin 1 and the second pin 8 welded with oxygen-free copper, during actual use, the pin cutting and bending do not affect the AT value, to completely avoid the above problem, so that a factory control parameter of the reed switch is consistent with an actual use parameter.

In this embodiment, the first pin 1 may be a hollow tube or a solid structure, to adapt to a mature pressing process or an one-time tube sealing and exhausting process in the field of vacuum ceramics, so that the hidden danger of glass tube breaking and air leakage due to the fact that after glass of a vacuum exhaust port of a cylindrical surface of a glass tube of a conventional large-load vacuum reed switch is melted to seal the exhaust port, a relatively large boss and seriously uneven wall thickness at the sealed part of the glass cause a large internal stress is completely eliminated, which is more convenient to use.

Finally, it should be noted that the foregoing embodiments are merely the preferred embodiments of the present invention and are not intended for limiting the present invention. Although the present invention is described in detail with reference to the foregoing embodiments, persons of ordinary skill in the art may still make modifications to the technical solutions described in the foregoing embodiments or make equivalent replacement to some technical features thereof. Any modifications, equivalent substitutions, improvements, and the like within the spirit and principles of the invention are intended to be included within the scope of the present invention.

What is claimed is:

1. A ceramic reed switch, comprising a ceramic tube, and a first end cover and a second end cover disposed on two ends of the ceramic tube, wherein a sealed chamber is inside the ceramic tube, a first pin is disposed on an outer side of the first end cover, a first magnetic reed is disposed on an inner side of the first end cover, the first magnetic reed forms a cantilever beam structure on the first end cover, a second pin is disposed on an outer side of the second end cover, a second magnetic reed is disposed on an inner side of the second end cover, the second magnetic reed forms a cantilever beam structure on the second end cover, free ends of the first magnetic reed and the second magnetic reed are overlapped in the ceramic tube and form an air gap, and a contact is disposed on an overlapped end of the first magnetic reed and the second magnetic reed; and under the action of an external magnetic field in a left-right direction, magnetic flux flows through the first magnetic reed and the second magnetic reed so that the first magnetic reed and the second magnetic reed attract each other at the air gap and are finally closed to cause a circuit to be connected, and after the external magnetic field disappears, the first magnetic reed and the second magnetic reed cause the contact to be separated and restored to an initial state under the action of elastic restoring forces of the first magnetic reed and the second magnetic reed, so that the circuit is cut off, wherein the first pin is a hollow tube, the first pin is hermetically welded to the first end cover, and an air hole passing through left and right is provided at a position where the first end cover corresponds to a center hole of the first pin.

2. The ceramic reed switch according to claim 1, wherein a boss is disposed on an inner side end of the first end cover, and the boss is connected to the first magnetic reed through a rivet or through welding.

3. The ceramic reed switch according to claim 1, wherein the first magnetic reed and the second magnetic reed form the contact on the overlapped end by coating a noble metal.

4. The ceramic reed switch according to claim 1, wherein the second pin is a solid pin, and the second pin and the second end cover are hermetically welded.

5. The ceramic reed switch according to claim 1, wherein a boss is disposed on an inner side end of the second end cover, and the boss is connected to the second magnetic reed through a rivet or through welding.

6. The ceramic reed switch according to claim 1, wherein the first pin and the second pin are pins made of non-magnetic oxygen-free copper materials.

7. The ceramic reed switch according to claim 1, wherein metallization layers are disposed on two end surfaces of the ceramic tube.

* * * * *